United States Patent [19]

Jeromson, Jr. et al.

[11] Patent Number: 4,925,061

[45] Date of Patent: May 15, 1990

[54] FLUID ACTUATED DISPENSER

[75] Inventors: James R. Jeromson, Jr., Aurora; J. Edward C. Anderson, Moreland Hills; John H. Breisch, Lakewood, all of Ohio

[73] Assignee: Milbar Corporation, Chagrin Falls, Ohio

[21] Appl. No.: 325,092

[22] Filed: Mar. 16, 1989

Related U.S. Application Data

[63] Continuation of Ser. No. 182,017, Apr. 29, 1988, abandoned, which is a continuation-in-part of Ser. No. 47,867, May 6, 1987, abandoned.

[51] Int. Cl.[5] ..... B65D 83/14

[52] U.S. Cl. ..... 222/1; 222/327; 222/389; 222/397; 222/473; 222/505

[58] Field of Search ..... 222/1, 326, 327, 387, 222/389, 397, 399, 470, 472, 473, 478

[56] References Cited

U.S. PATENT DOCUMENTS

| | | | |
|---|---|---|---|
| Re. 28,120 | 8/1974 | Plumer | 222/326 |
| 2,818,999 | 1/1958 | Miller | 222/323 |
| 2,872,083 | 2/1959 | Murphy et al. | 222/327 |
| 3,138,303 | 2/1961 | Hoveland | 222/389 |
| 3,439,939 | 9/1965 | Schumann et al. | 222/389 X |
| 3,640,431 | 2/1972 | Plumer | 222/48 |
| 3,910,466 | 10/1975 | Collar | 222/327 |
| 4,174,068 | 11/1979 | Rudolph | 222/327 X |
| 4,231,492 | 11/1980 | Rios | 222/1 |
| 4,299,336 | 11/1981 | Studer | 222/387 X |
| 4,376,498 | 3/1983 | Davis | 222/326 |
| 4,386,717 | 6/1983 | Koob | 222/389 X |
| 4,453,651 | 6/1984 | Braithwaite et al. | 222/82 |
| 4,685,596 | 8/1987 | Mattheis | 222/384 |

OTHER PUBLICATIONS

Catalog of Beyer & Auto—DG-1 at Appendix A.

*Primary Examiner*—Andres Kashnikow
*Assistant Examiner*—William Grant
*Attorney, Agent, or Firm*—Watts, Hoffmann, Fisher & Heinke Co.

[57] ABSTRACT

A liquefied gas operated caulk dispensing gun with a housing sub-assembly having an elongate tubular housing defining a chamber for accommodating a tube of caulk, an open dispensing end and an opposite valved closed end portion. A material dispensing sub-assembly is also provided removably connected to the dispensing end of the housing sub-assembly to form a dispensing assembly. The dispensing sub-assembly includes a nozzle, a caulk flow passage communicating with the chamber housing, wherein the flow passage is sized to accommodate a caulking tube outlet. The material sub-assembly also includes a valve controlled passage for selective communication between an inlet portion of the flow passage and the nozzle, and a flow control valve movable between open and closed positions to control such selective communication. A seal mechanism is positioned in the dispensing assembly to effect a seal between the flow passage and a charge receiving portion of the chamber. A valve is included on the valved end portion of the housing to permit liquefied gas to enter the charge receiving portion for the dispensing of caulk, and for venting the charge receiving portion when the housing sub-assembly is to be disconnected from the material sub-assembly. A lever mechanism is operatively connected to the flow control valve for moving the valve from one position toward the other.

17 Claims, 6 Drawing Sheets

FLUID ACTUATED DISPENSER

This is a continuation of co-pending application Ser. No. 07/182,017 filed on 4/29/88 now abandoned, which in turn is a Continuation-In-Part of application Ser. No. 07/047,867 filed 5/6/87, now abandoned.

TECHNICAL FIELD

This invention relates to viscous material dispensers and more particularly to a caulking gun adapted to receive a disposable tube of caulking material and utilize liquefied gas as a propellant medium for dispensing the viscous material.

BACKGROUND ART

Manufacturers of caulking materials often package the materials in disposable cartridges. A cartridge typically is a wound fiberboard tube with an apertured metallic ring crimped to one end. A generally conical plastic member is carried by the ring to provide a closure and, when a portion near the tip is severed a desired amount, to provide a dispensing nozzle when the cartridge is used. The tube is substantially filled with caulking or other mastic material and a piston is inserted in the end portion of the tube opposite the ring.

Operator actuated caulking guns for dispensing caulk from cartridges have received wide acceptance. Such guns typically have a forward, apertured, slotted, tube restraining end. The nozzle is inserted through the aperture and the ring abuts the forward restraining end of the caulking gun. A plunger is provided to act against the caulking cartridge piston. The plunger is typically mounted on an elongated rod which is advanced through ratcheting action to apply dispensing pressure to the cartridge piston.

Typically such a caulking gun will include a handle which depends from the gun near the end remote from the restraining end, and a pivotal lever mounted in the handle. Actuation of the lever drives the rod forward through any one of a number of forms of ratcheting mechanisms to in turn drive the plunger against the piston.

A number of proposals have been made for utilizing pressurized gas for dispensing caulk. The objective of such proposals is to provide more uniform dispensing especially for professional tradesmen. They also seek to reduce operator fatigue and the occurrence of such problems as hand cramps when caulk dispensing operations are continued over a substantial period of time. While the proposals have had such objectives all have had material drawbacks with resultant limitations on their use.

A number of proposals have been made for pneumatically actuated dispensing guns. Most such proposals have relied on a connected supply of pressurized air which results in limitations as to locations where such guns can be used. In addition the connected air lines can interfere with use of such pneumatic dispensers and provide a drag on the movement of such a dispenser.

There has been at least one proposal for a pneumatically actuated caulking dispenser which did not require a connected air line. Rather, the device included a plenum chamber which was to be charged with a supply of pressurized air used to drive the piston. The piston in turn was housed in a cylinder and connected to a projecting rod which drove a plunger. In short, the plenum chamber and the piston and the cylinder were relatively heavy and bulky substitutes for the ratcheting mechanism in the conventional hand-actuated caulking gun.

A mechanical structure was provided to normally prevent piston motion and selectively enable it. One disadvantage to such an arrangement is obviously once the mechanics experience some wear, constant pressure application against the piston is apt to cause unintended discharge of caulking material. Another disadvantage of this proposal is that pressure available to dispense caulk is obviously continuously decreasing as the volume occupied by the air increases during dispensing operations. Unless there is a very large and structurally strong structure defining the plenum the performance of such a pneumatically actuated gun could obviously continuously decline as caulking operations are performed.

A further problem with the proposed pneumatically charged gun is so-called "after ooze", a problem present with most prior art caulking dispensers. As the caulk is pressurized to effect the dispensing operation, air or other gases entrained in the mastic material are compressed. When dispensing pressure stops these entrained gases expand to their original volume causing the mastic material to continue to flow out the nozzle, the so-called after ooze. The proposal for a pneumatically charged gun would deal with the after ooze problem by providing an operator actuated mechanism to drive the piston rearwardly at the conclusion of a caulk-applying operation to permit the caulk to expand rearwardly rather than cause continued flow out the nozzle. Thus, while the proposal would eliminate the need for operator-applied force to expel caulk it would create such a need to prevent after ooze, and that force would have to be applied against substantial air pressure.

Others have proposed the use of carbon dioxide cartridges or other liquefied gas containers connected to and carried by the material dispensing mechanisms. These devices are unduly complex and heavy and exhibited several problems. When caulk is to be dispensed the valve is opened to allow carbon dioxide gases to escape from the cartridge and be supplied to a piston actuating chamber in the gun. At the conclusion of the dispensing operation, to deal with the after ooze problem, such a chamber was to be vented. This not only is wasteful of the pressurized gas but exacerbates a second problem. The second problem is that such a device is attitude sensitive. That is, if the gun is positioned in certain attitudes when the valve is open to effect a dispensing operation, liquid carbon dioxide will flow through the valve into the chamber being charged. Once that has happened caulk flow cannot be stopped until either (1) enough $CO_2$ has been vented to the atmosphere to cause all of the liquefied $CO_2$ in the chamber to become gaseous and the pressure reduced to the point where it is low enough the caulk will not be expelled or (2) enough caulk has been expelled to permit complete gasification of the $CO_2$. Unfortunately, the latter may not occur until the entire contents of the caulking tube has been dispensed.

Another problem with fluid actuated devices has also been discovered. The problem is that the seal between the wall of the tube and the tube's piston may not prevent liquefied gas from flowing inside the tube, especially where the tube is plastic. As a result, fluid is able to get in front of the piston and work its way down toward the nozzle so that when caulk is expelled from the nozzle, bubbles of liquefied gas are also expelled. The popping of the bubbles dispensed from the device results in "sputtering", or the random distribution of small particles of caulk.

A further problem with $CO_2$ cartridge actuated devices is that as the liquefied $CO_2$ expands and passes through the control valve in gaseous form it is absorbing heat. This can result in the valve being frozen open, frosting of valve surfaces and other undesirable effects.

Some relatively expensive materials such as silicone gasket forming materials have been sold in disposable pressurized carriers. While such disposable pressurized dispensers have been used, their use has been limited to relatively expensive materials for low volume application and would be uneconomic if used for such applications as dispensing the caulking compounds used by house painters.

There has been at least one proposal for a $CO_2$ actuated mastic material dispenser of a $CO_2$ actuated device in which it was proposed to control the flow of material at the outlet. The device was unduly complex and heavy, was difficult to clean, and would only accept the cartridges of the type which take a screw-on nozzle rather than the far more readily available type in which a disposable conical tip is provided that is cut to form the nozzle.

SUMMARY OF THE INVENTION

According to the present invention a liquefied gas actuated viscous material dispensing gun is provided. The gun is a self-contained unit which is charged with liquefied gas so that a substantially constant caulk propellant force is provided throughout the dispensing of a caulking cartridge.

A gun made in accordance with this invention will accept either a screw-on nozzle type cartridge or a more commonly available type where the end closure is severed to form a nozzle. After ooze is prevented and very precise flow control is achieved through the use of a novel material dispensing or discharge control sub-assembly. The sub-assembly includes a flow passage that is axially aligned with a cartridge and a transverse intersecting valve passage. A spool valve is reciprocally mounted in the valve passage for selectively enabling the dispensing of caulk.

In an alternate and now-preferred embodiment of the dispensing sub-assembly, a flow control valve and a safety valve are reciprocally mounted in the valve passage and contained by a release knob. The flow control valve enables the selective and proportional dispensing of caulk. The safety valve is operational only when the operator attempts to remove the release knob, for cleaning of the valves, etc., without first venting the liquid gas pressurizing the caulk. Operation of the safety valve reminds the operator that venting must still be performed and discourages continued attempts to remove the knob.

A tubular housing and valve sub-assembly are connected to the dispensing sub-assembly and bias a contained tube of caulking material into sealing engagement with a gasket carried by the dispensing sub-assembly. This cartridge to gasket engagement prevents fluid communication between the flow passage cartridge communication and a charge receiving portion of the housing chamber which receives a charge of liquefied gas. Thus, the piston of the throwaway cartridge itself is used to expel caulk from the cartridge under gas pressure provided by the liquefied gas. Because the gun is itself charged with liquefied gas it is not attitude sensitive nor does it have the frosting or freezing problem of carbon dioxide or other liquefied gas cartridge devices.

The housing and valve sub-assembly includes a vent valve which projects outwardly rearwardly of the housing. The housing is threaded into the dispensing sub-assembly for facile disconnection once caulk in a tube has been dispensed. The venting valve is configured such that the operator will notice it as he commences to disconnect the housing sub-assembly from the material dispensing sub-assembly and will be reminded to vent the chamber before such disconnection is effected. Further the vent valve is constructed to remain open throughout a disconnection and spent cartridge removal operation.

If the operator, in spite of the reminder provided by the venting valve, fails properly to vent the chamber, or in the event that there is still a significant quantity of liquefied gas in the chamber at the end of the dispensing operation such that the venting of the chamber does not in fact remove all liquefied gas, further provision for venting is included. More specifically, and in the preferred and disclosed arrangement, the housing sub-assembly is threaded into the material dispensing sub-assembly. Radially disposed venting passages are formed through the threaded part of the material sub-assembly. As unthreading of the two commences and the seal is broken, gases will vent through the loosening threads and/or the radially disposed venting passages to assure that pressure is released at the time when the two sub-assemblies are disconnected.

In an alternate and now preferred embodiment of the housing and valve sub-assembly, a second seal is provided between the tube of caulking material and the liquefied gas cartridge. The second seal is provided by a sleeve supported on the housing, an apertured nut member supporting the vent and charging valves and threadedly engaged with the housing, and an expandable charge receiving portion with an open end portion defined by a seal ring member which is engaged between the sleeve and nut member to prevent fluid communication to locations other than the charge receiving portion. The expandable charge receiving portion comprises a bellows with a generally accordion-like tubular wall portion which is expandable between a normally collapsed position and an extended cylindrical position. One end portion of the tubular wall portion is the open end portion with the seal ring member. An opposite end of the tubular wall portion is spaced from the open end portion and includes a closed end wall portion secured to the tubular wall portion. When the bellows expand under pressure of the liquefied gas charge, the closed end wall portion engages the piston of the throwaway cartridge and the piston expels caulk from the cartridge.

The expanding charge receiving portion is vented by a vent valve projecting rearwardly outwardly of the nut member, which is threaded into a threaded end of the housing opposite the dispensing sub-assembly. Operation of the venting valve is as set forth above.

A pistol-grip type handle and lever structure is provided. The handle and lever structure is removable connected to the assembly. The structure includes a yoke section that straddles the dispensing sub-assembly. The structure is so constructed that gases venting through the radially disposed apertures are vented into the structure to inhibit impingement of the vented gases directly into contact with an operator.

The connection of the structure to the assembly is located to permit the selective separation of the structure from the assembly without disconnecting the sub-assemblies from one another or conversely the disconnection of the sub-assemblies without disconnection of the structure.

The disconnection of the sub-assemblies from one another and the structure from the sub-assembly facilitates thorough and simple cleaning when a caulking procedure has been completed. Moreover, selectively connectable dispensing nozzles are provided and a spool retaining cap is provided so that one can readily disassemble the material dispensing sub-assembly and quickly and thoroughly clean it. In the preferred embodiment of the dispensing sub-assembly, the removal of the release knob enables the operator to remove and clean the safety and flow control valves and to clean the valve passage.

Accordingly, an object of the invention is to provide a novel and improved liquefied gas actuated dispensing gun and a process of dispensing viscous material.

Additional objects and features of the invention will become apparent and a fuller understanding obtained by reading the following detailed description made in connection with the accompanying drawings.

BEST MODE FOR CARRYING OUT THE INVENTION

Figure 1:
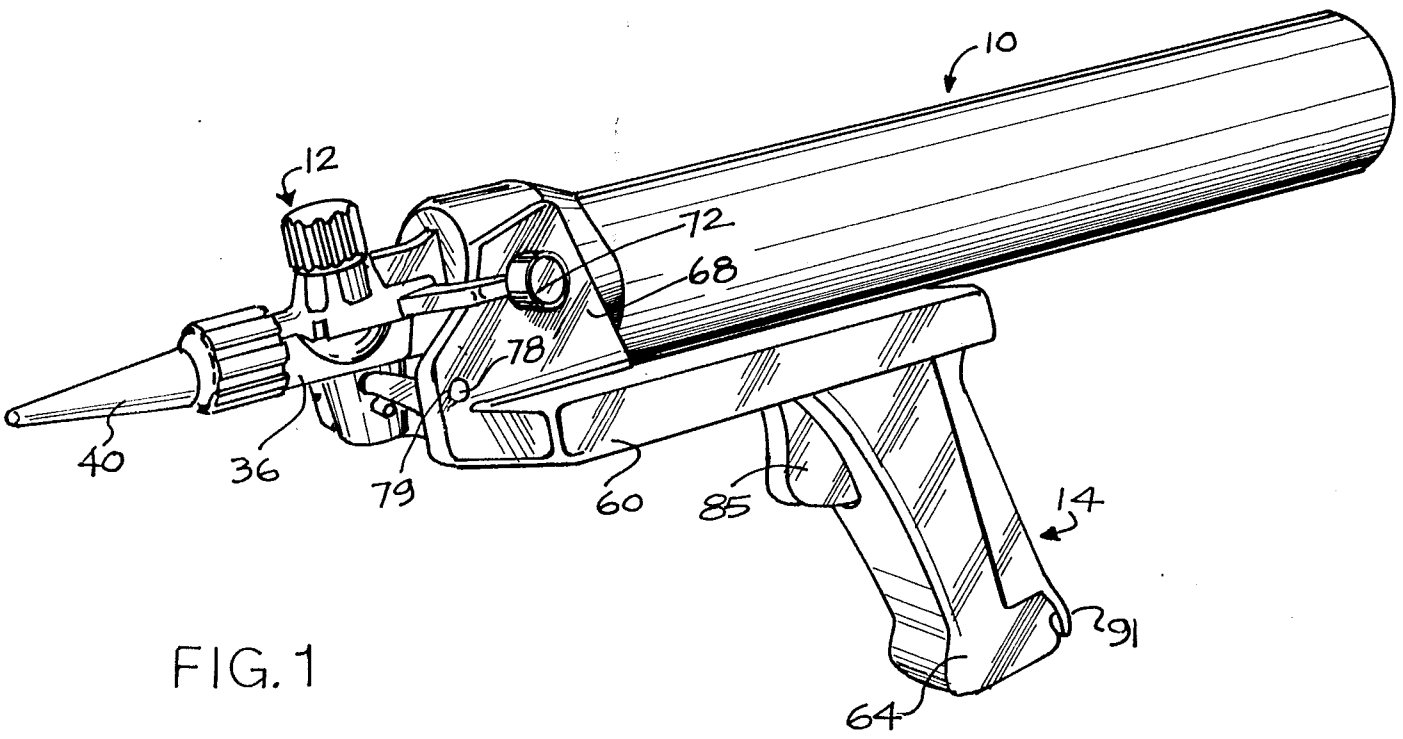
FIG. 1 is perspective view of a dispensing gun of this invention.
Figure 2:
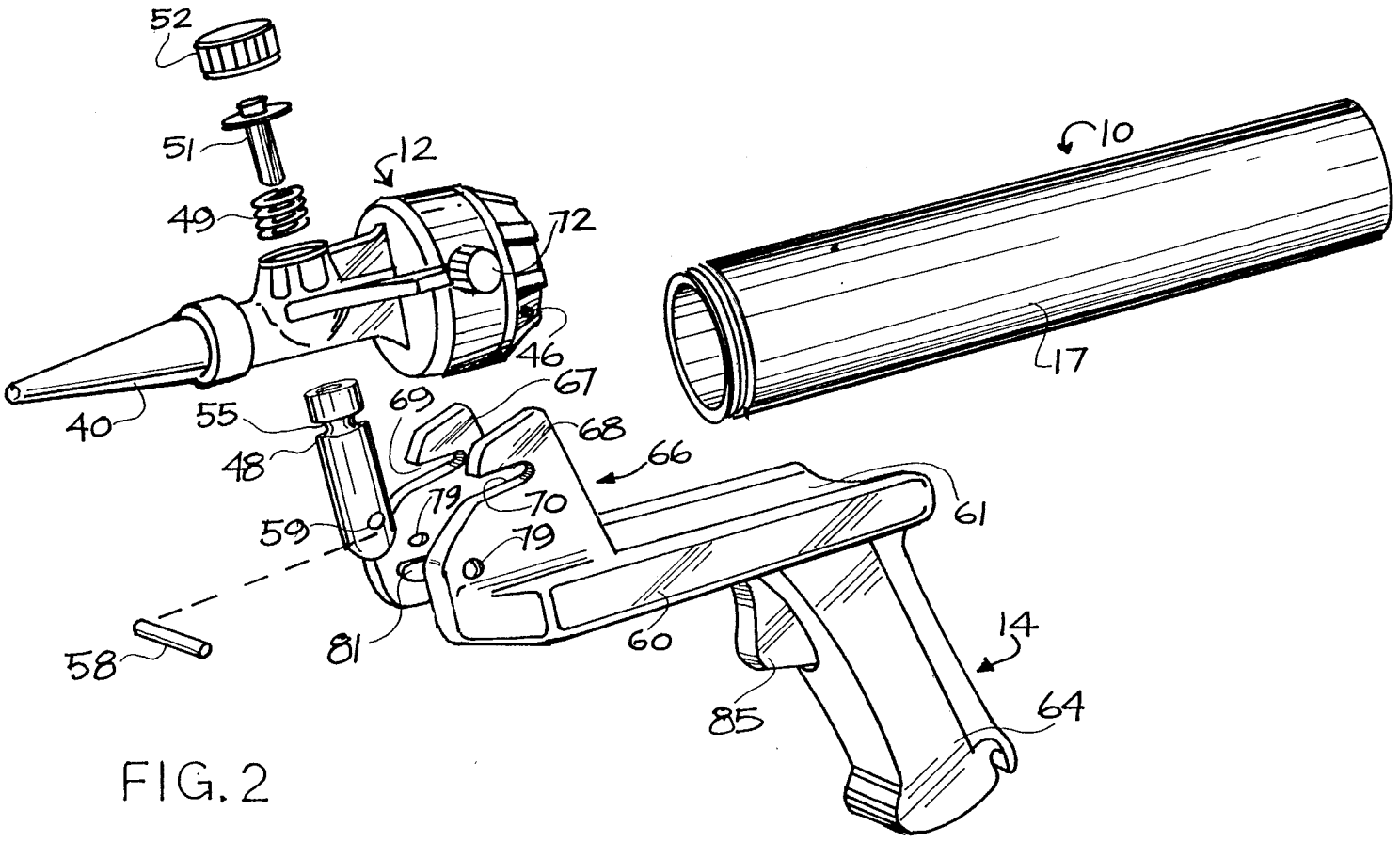
FIG. 2 is an exploded view of the gun of FIG. 1.

Referring to the drawings and to FIGS. 1 and 2 in particular a caulking gun of this invention is comprised of three readily separable components. These components are a housing and valve sub-assembly 10 which is threadedly connected to a material dispensing sub-assembly 12 and a pistol-grip handle and lever structure 14 removably connected to the material dispensing sub-assembly 12.

Figure 3:
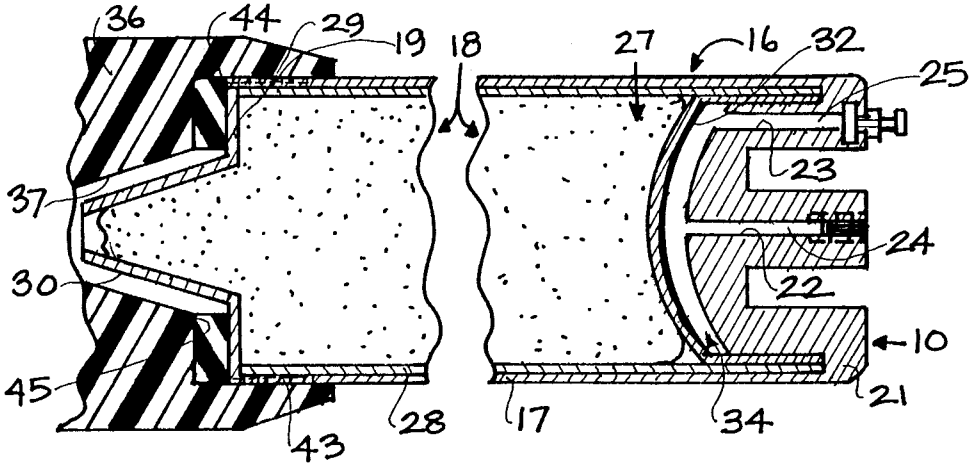
FIG. 3 is a foreshortened sectional view of the housing and sub-assembly and a portion of the material dispensing sub-assembly with a caulking tube contained therein.

As is best seen in FIG. 3 the housing and valve sub-assembly 10 includes an elongate tubular housing 16. The housing 16 includes generally cylindrically contoured and imperforate walls 17 defining a chamber 18. Near the left hand end as viewed in FIG. 3 the housing 16 has a threaded section 19. The threaded section 19 surrounds an open discharge end of the housing 16.

An opposite end wall 21 is provided at the end of the housing 16 opposite the threaded section 19. The end wall 21 includes charge and vent valve receiving apertures 22, 23. Charge and vent valves 24, 25 are respectively mounted in the charge and vent valve apertures 22, 23 to provide a valved but otherwise closed end of the housing. For safety purposes, a pressure relief valve, not shown, should also be provided in the housing and valve sub-assembly 10.

A caulking cartridge is shown generally at 27. The cartridge includes the usual wound fiberboard tube 28. An annular, metallic, end ring 29 is crimped to the left hand end of the tube 28 as seen in FIG. 3. A nozzle 30 is carried by and connected to the end ring 29. A quantity of viscous material such as caulking compound 31 fills the tube. A piston 32 closes the end of the tube opposite the nozzle 30. The piston 32 and the valved end wall 21 together define a charge receiving portion 34 of the chamber 18.

Figure 8:
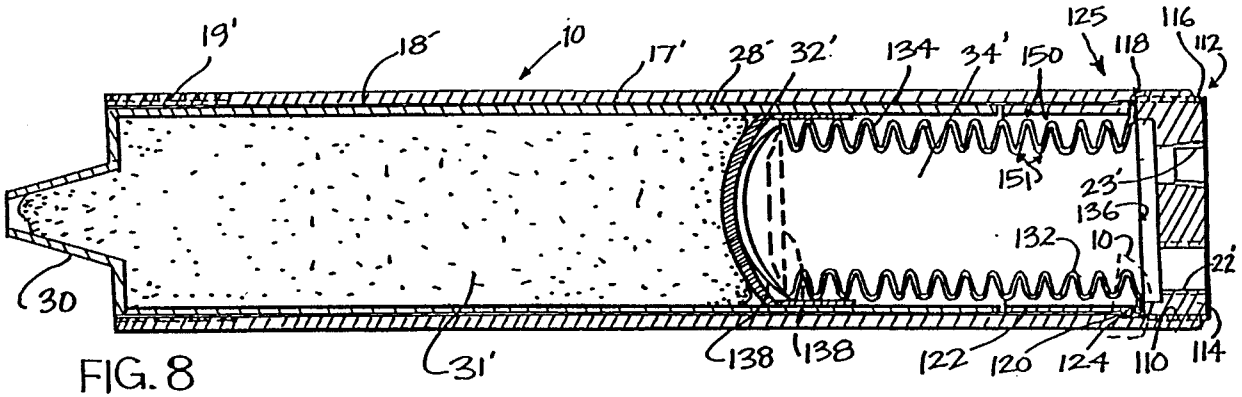
FIG. 8 is a sectional view of an alternate embodiment of the housing and sub-assembly with a partially dispensed tube of caulking contained therein.
Figure 9:
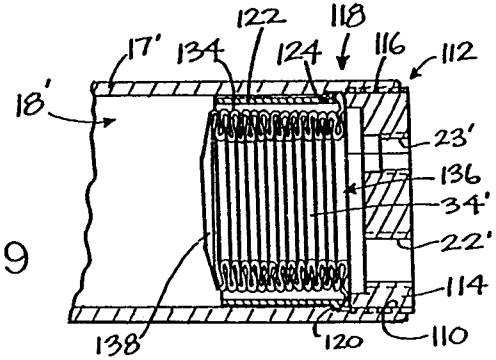
FIG. 9 is a partial sectional view of an end of the FIG. 8 embodiment of the housing and sub-assembly, with the charge receiving portion shown in a collapsed condition.
Figure 10:
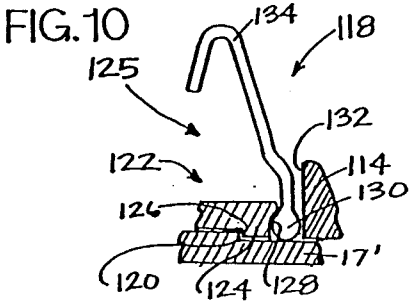
FIG. 10 is an enlarged partial view of the charge receiving portion engaged with the sleeve as indicated in FIG. 8.

An alternate embodiment of housing and valve sub-assembly is shown in FIGS. 8, 9 and 10. As a number of the elements of the embodiment previously described are similar to those of the alternate embodiment, common elements will be referenced using a prime designation.

The sub-assembly 10' illustrated in FIG. 8 includes an elongate tubular housing 16' which is generally cylindrically contoured, and imperforate walls 17' defining a chamber 18'. The housing 16' has an externally threaded section 19' near the left hand end as shown in FIG. 8, which surrounds an open discharge end of the housing 16'. An internally threaded section 110 is provided on a valve end 112 of the housing which is opposite the end supporting threaded section 19'. The threaded section 110, surrounds the valve end 112 of the housing 16', and supports an apertured nut 114 which includes charge and vent valve receiving apertures 22', 23'. The nut 114 includes an external threaded section 116 for engagement with the threaded section 110 during operation of the invention. Charge and vent valves (not illustrated) are respectively mounted in the charge and vent valve apertures, 22', 23' to provide a valved but otherwise closed valve end 112 of the housing, as in the embodiment of FIG. 3.

As shown in FIGS. 8–10, a seal 118 is provided between the valve end 112 and the caulking cartridge 27'. The seal 118 includes an annular shoulder 120 extending radially inwardly from the housing wall 17' into the chamber 18' and an annular sleeve 122 for engagement within the housing. The sleeve 122 includes a flange portion 124 extending radially from the sleeve on an end 125 of the sleeve near the valve end 112 of the housing. As shown in FIG. 10, the flange 124 includes a shoulder abutment surface 126 for engagement with the wall shoulder 120. The flange 124 also includes a grooved portion 128 for engagement with a seal ring portion 130 of the charge receiving portion 34'. Operation of the seal 118 which limits the flow of liquefied gas to the charge receiving portion 34' is enabled when the seal ring portion 130 is compressed between the grooved portion 128 and an engagement surface 132 on the nut 114 threadedly engaged with the housing. The seal ring portion 130 is thus deformed on three sides to provide a three-way seal intermediate the nut, housing and charge receiving portion.

In the present and now preferred embodiment, the charge receiving portion comprises an expandable and accordion-like bellows 134, preferably manufactured of a polymer material such as Polychloroprene, also known as Neoprene. The bellows 134 includes an open end portion 36 defined by the seal ring member 130, and a closed end portion 138 for deformable engagement with the caulking tube piston. As in the embodiment shown in FIG. 3, the caulking tube 28', filled with viscous material caulking compound 31', is engaged within the chamber 18'. Compound 31' is dispensed from nozzle 30' upon pressure to the piston 32' by the closed end portion 138 of the bellows 134 which are expandable upon being charged with liquefied gas.

The bellows is molded in the general dimension shown in FIG. 8, and includes a series of annular peak 150 and valley 151 portions. The bellows is adapted to be collapsed to the condition shown in FIG. 9, wherein adjacent peak and valley portions are in contact. In the condition shown in FIG. 9 the closed end of the bellows is engagable with the piston 32' of a full tube of caulking compound. During operation, the closed end portion 138 is believed to expand from the molded condition shown in phantom in FIG. 8, to the condition illustrated in solid, whereby the end portion 138 more completely biases the piston 34'.

The bellows 134 is also adapted for expansion to a completely extended condition (not illustrated), wherein the closed end 138 of the bellows is near the open end 19' of the housing to contact the piston of a nearly empty tube of caulking compound. In this condition the peak and valley portions are continuous and thus form a generally smooth wall portion (not illustrated).

Figure 5:
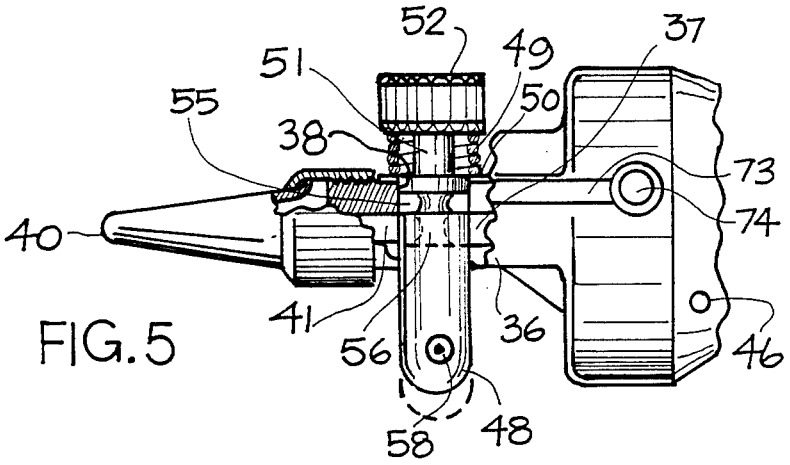
FIG. 5 is a side elevational view with parts broken away and removed for clarity of illustration of the material dispensing sub-assembly.

An original embodiment of the material dispensing sub-assembly 12 is shown in FIG. 5. This sub-assembly includes a body 36. The body includes a material flow passage 37 which extends axially through the body. The body includes a transversely disposed valve passage 38 which perpendicularly intersects the material flow passage 37. Preferably the axes of the two passages are perpendicular and intersecting.

A removable nozzle 40 is carried by the body 36. The nozzle 40 is axially aligned and in communication with a valve controlled portion 41 of the material flow passage 37. The body 36 includes an internally threaded end section 43 which removably receives the threaded section 19 of the housing 16. When housing and valve and the material dispensing sub-assemblies are threaded together as shown in FIG. 3 they form a caulk dispensing assembly for retaining a caulking cartridge.

For caulk dispensing purposes the flow passage 37 will be seen to communicate with the housing chamber 18. An annular seal element 44 is carried by the body 36 against a wall 45 which forms the forward end of the threaded end section 43. When the sub-assemblies are assembled the seal 44 is squeezed between the caulking tube end ring 29 and the radially disposed wall 45. The seal 44 is effective to prevent the passage of propellant around the cartridge and into the material flow chamber 37. The mastic material 31 and the piston 32 prevent the flow of propellant through the cartridge and thence the flow control passage. Consequently the charge receiving portion can be seen to be initially the space as shown by the arrow 34 but a space of increasing volume as the piston moves axially to the left as seen in FIG. 3. The charge receiving volume is also a space which will include a slight clearance between the cartridge 27 and the housing walls 17.

A flow control spool valve 48 is mounted in valve passage 38. A spool positioning spring 49 is provided. The spring 49 is positioned in an enlarged end bore and rests against a shoulder 50 of the body 36. The spring is axially aligned with and above the valve passage 38. A headed and threaded spring engaging element 51 is provided, FIG. 2. The headed and threaded element 51 is threaded into the valve spool 48 with its head overlying the spring 49 so that the spring biases the spool 48 upwardly. A spool valve retaining cap 52 is threaded onto the body 36 to maintain the spool valve 48 and the spool positioning spring in the body 36.

In FIG. 5 the spool is shown in solid lines in its closed position. In that position the spring 49 is not compressed. The open position is shown in phantom when a flow permitting portion 55 of the spool is aligned with the flow passage 37. Thus, with the spool in the phantom line position shown in FIG. 5 viscous material can flow form the cartridge, through the flow passage, past the flow permitting portion and out the valve controlled portion 41 of the flow passage 37 into the nozzle 40. The spool 48 has a normally closed position in which its lower cylindrical surface 56 functions as flow blocking surfaces by coacting with the valve passage 38 to close off the material flow passage 37.

A spool positioning pin 58 is provided. The spool positioning pin extends through a bore 59 in the spool and projects radially in diametrically opposed directions near the base of the spool as viewed in FIG. 5.

The threaded end section 43 includes a pair of radially disposed vent passages one of which is shown at 46. These vent passages act as structure for venting the chamber 18 as the sub-assemblies are disconnected from one another. Thus the vents assure that the sub-assemblies can be safely disconnected even if there is residual gas pressure in the chamber 18.

An alternate and now preferred embodiment of the material dispensing sub-assembly is shown in FIGS. 11–14. As a number of the elements of the previously described dispensing sub-assembly are common to the embodiment of FIGS. 11–14, a prime designation will be used to reference those elements. The material dispensing sub-assembly of the now preferred embodiment is partially illustrated in FIG. 12. The sub-assembly includes a body 36' having a collar portion 200, which threadedly engages the housing and valve sub-assembly, as in the embodiment illustrated in FIG. 3, a valve body 202, a release knob 203, and cooperating spring biased safety and flow control valves 230 and 240.

Figure 11:
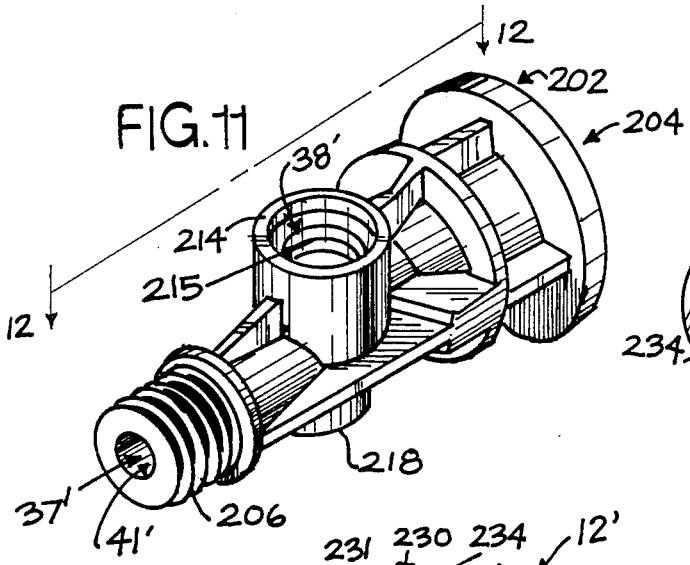
FIG. 11 is a perspective view of the valve body of the now preferred material dispensing sub-assembly.
Figure 12:
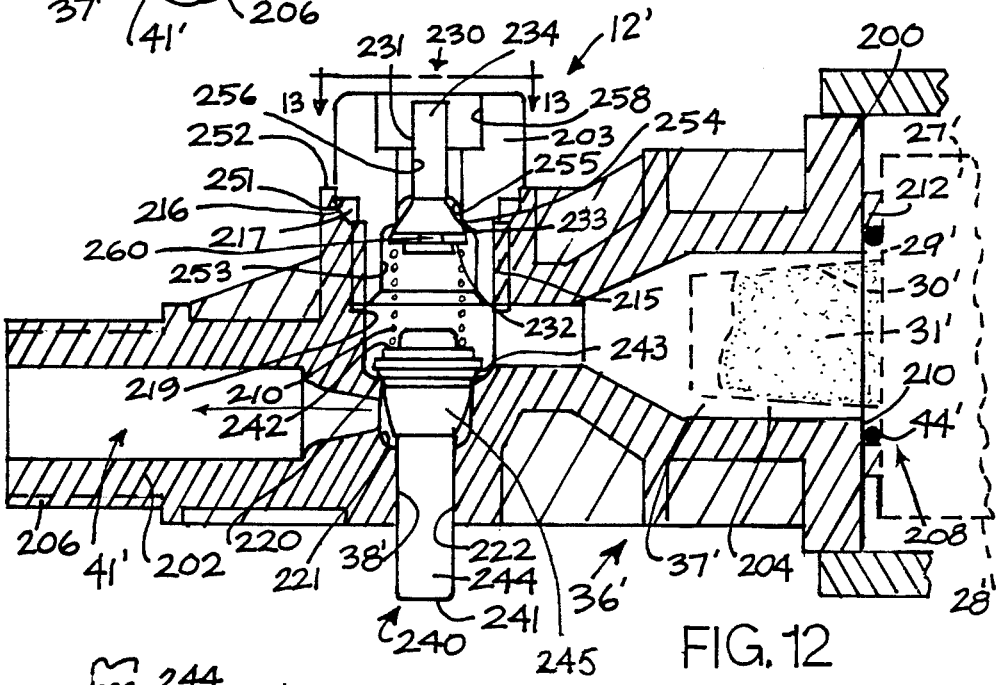
FIG. 12, is a partial sectional view of the material dispensing sub-assembly taken along the line 12—12 of FIG. 11.

The valve body 202, illustrated in FIG. 11, includes a material flow passage 37' which extends through the body, and a valve passage 38' which is transversely disposed with respect to the material flow passage 37'. As shown in FIG. 12, the flow passage includes a first portion 204 for receiving caulking compound under pressure from the caulking cartridge 27', and a valve controlled portion 41' which receives the caulking compound from the valve passage. Central axes of the first and valve controlled portions 204, 41' are offset from one another, and perpendicular to and intersecting the valve passage 38'. The arrows in FIG. 12 indicate the flow of caulk material 31' to a removable nozzle (not illustrated) during operation.

Figure 6:
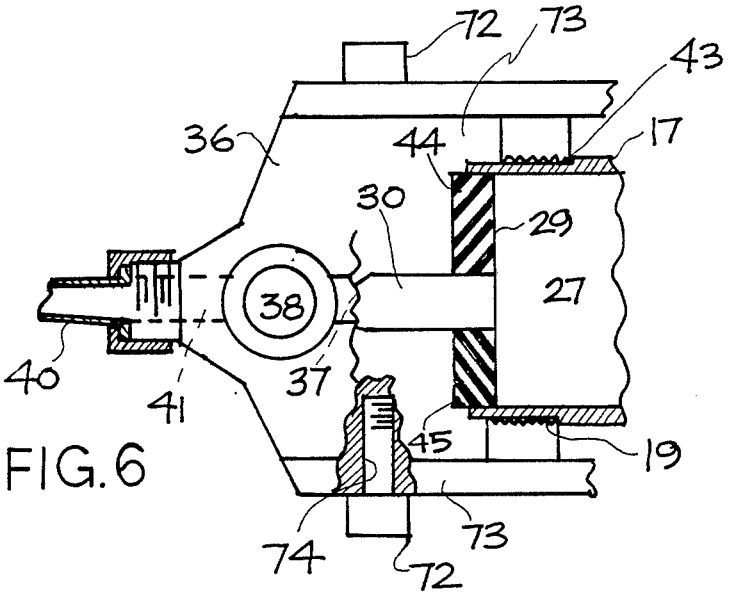
FIG. 6 is a partially sectional, otherwise top plan, view of the dispensing sub-assembly.

The nozzle is carried by the valve body 202, and is axially aligned and in communication with the valve controlled portion 41' of the material flow passage 37'. The valve body 202 includes an externally threaded end portion 206 which removably receives the threaded section of the nozzle, as in the embodiment of FIGS. 5 and 6. The valve body also includes an opposite end portion 208. The end portion 208 is spaced from the threaded end portion 206, and in fixed engagement with the collar portion 200 by adhesive material to form a unitary dispensing sub-assembly. When the housing and valve sub-assembly and the unitary material dispensing sub-assembly are threaded together they form a caulk dispensing assembly.

When the sub-assemblies are assembled, a seal 44' is carried on an abutment surface 210 of the opposite end portion 208, which is radially inwardly of an annular lip portion 212 raised from the abutment surface 210. The seal engages an end 29 of the caulking compound tube to prevent the passage of any charging material around the cartridge and into the flow passage.

The release knob 203, spring 210 and safety and flow control valves 230, 240 are mounted within the valve passage 38' of the valve body. The valve passage 38' includes a safety valve receiving portion 214 for housing the release knob 203 and safety valve 230, and a flow control valve receiving portion 218 for receiving the flow control valve 230. The safety valve receiving portion 214 includes an internally threaded portion 215 for threaded engagement with the knob 203, and a seal seat 216 for engagement with a seal element 217 which is deformed between the seal seat and the knob, when in the assembled condition, to prevent leakage of caulk material past the internally threaded portion 215.

The flow control valve receiving portion 218 includes a first diameter opening 219, a valve seat 220, a second smaller diameter opening 221, and a flow control valve plunger opening 222. The first diameter opening is intersected by the first portion 204 of the flow passage 37', and the second diameter opening 221 is intersected by the flow controlled passage 41'. The valve seat 220 is located intermediate the first and second diameter openings for engagement with a flow control plunger.

As illustrated in FIG. 12, each of the safety and flow control valves 230, 240 includes a plunger 231, 241 having a spring abutment surface 232, 242, a seat engagement surface 233, 243, and an actuating member 234, 244. The flow control valve plunger 241 further includes a bowl shaped portion 245, which is located intermediate the seat engagement surface 243 and actuating member 244, and sized to be of a larger diameter adjacent the seat engagement and a smaller diameter adjacent the actuating member. The spring 210 is engaged with the opposed spring abutment surfaces 232, 242 to bias the plungers 231, 241 away from one another, and is axially aligned with the valve plungers and valve passage 38'.

The release knob 203, as shown in FIG. 12, forms part of the safety valve 230, engages the safety valve plunger, and captures the valves 230, 240 within the valve passage 38'. When the knob is removed from the sub-assembly the operator is able to access the valves and valve passage for cleaning purposes.

Figure 13:
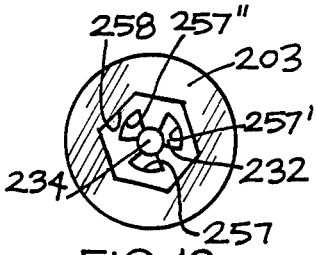
FIG. 13 is a top view of the material dispensing sub-assembly taken along the line 13—13 of FIG. 12.

The knob includes an externally threaded portion 250 for engagement with threaded portion 215, a seal abutment surface 251 for deformation engagement with the seal element 217, and a valve body abutment surface 252 for engaging the valve body. The knob further includes an internal first diameter opening 253, a safety valve seat 254, a second smaller diameter opening 255, and an axially aligned safety valve plunger aperture 256 for receiving the safety valve plunger 231. The safety valve seat 254 is located intermediate the first and second diameter openings for engagement with the seat engagement surfaces 233 of the safety valve plunger 234. Also provided, adjacent to and in communication with the plunger aperture 256, are three safety caulk exits 257, 257' and 257", which are best illustrated in FIG. 13. The exits are in communication with a hexagonal opening 258 for receiving a conventional hexagonal "Allen" key to insert and remove the release knob from threaded engagement with the valve body.

The safety valve 230 is operational when the operator attempts to disengage the release knob from the valve body while caulk material under pressure from the housing and valve sub-assembly is in the first portion 204 of the material flow passage. As the hexagonal wrench is inserted into the knob opening 258, the actuating member 244 of the safety valve plunger is moved in a downward direction against the spring 210. The downward movement disengages the seat engagement surface 243 from the safety valve seat 254, in the closed position of FIG. 12, and enables caulk to flow from the first diameter opening 253 to the second diameter opening 255 and out the caulk exits 257, 257', 257" to the hexagonal opening. Flow surfaces 260 are also provided on the safety plunger 231 to provide a larger opening for caulk flow once the plunger is unseated from engagement with the knob. Since the operator is using the wrench in the hexagonal opening, the entrance of the caulk material into the opening and partially expels the wrench from the opening 258 to provide an indication to the operator that he has forgotten to vent the charge receiving portion, and thus discourages further attempts to unthread the release knob 203 from the valve body 202 until the pressure is released.

In FIG. 12, the material dispensing sub-assembly is shown in the closed position, wherein the valve plungers are engaged through their respective apertures to project from the valve body. The spring 210 biases the plungers away from one another, and into sealing engagement wherein the safety valve seat engagement surfaces 233 engages the safety valve seat 254 of the release knob, and the flow control valve seat engagement surface 243 engages the valve seat 220. The safety and flow control valves thus prevent the flow of caulk past the plungers.

Upon upward movement of the flow control plunger, via the actuating member against the spring 210, the valve seat 220 and seal engagement surface 243 are disengaged so that caulk material is permitted to flow from the first diameter opening 219 to the second diameter opening 221 and into the flow controlled passage 41'. The amount of caulk material which flows to the passage 41' is related to the distance the flow control plunger is moved upwardly. As the upward movement of the plunger is increased, the configuration of the bowl shaped portion 245 provides a correspondingly larger space between plunger and first and second diameter portions, and enables increased caulk flow.

Referring to FIG. 2, the handle and lever structure 14 includes a stem section 60. The stem section 60 includes an upwardly directed semi-cylindrically contoured dish surface 61. The dish surface 61 is shaped to abut and extend along the wall 17 of the housing 16.

A grippable handle section 64 is provided. The handle section 64 depends in pistol grip relationship from the stem section 60. As is best seen in FIG. 1, the stem section is sized to position the handle section 64 such that it is aligned with a fore and aft center of gravity of the tool and thus provides a balanced location for the operator to grip the handle.

The handle and lever section includes a forward yoke section 66 projecting upwardly from the stem section 60 when the handle section 64 is projecting downwardly. The yoke section includes a spaced pair of arms 67, 68 which are adapted to straddle the material dispensing sub-assembly 12. The arms 67, 68 respectively have fastener receiving apertures in the form of forwardly extending open ended slots 69, 70, FIG. 2. The handle and lever section is removably connected to the assembly by a pair of headed fasteners, one of which is shown at 72, that extend through the slots 69, 70 and clamp the arms 67, 68. The arms are clamped against ribs of the body 36, one of the ribs being shown at 73. The fasteners 72 thread into threaded apertures in the body 36, one of which is shown at 74 in FIGS. 5 and 6.

Figure 4:
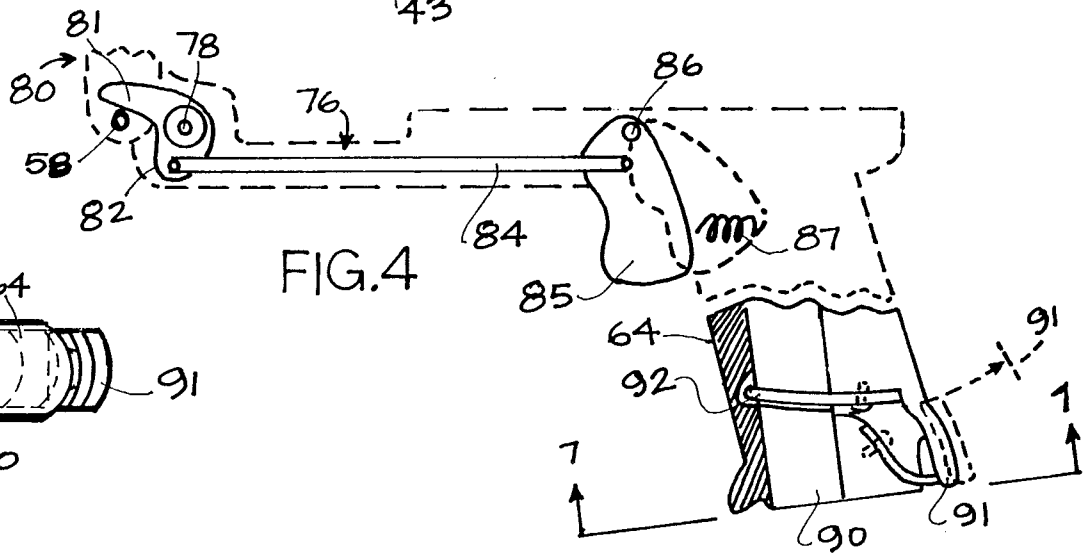
FIG. 4 is a schematic view of a valve actuating linkage system and a partially sectioned view of the handle section.

The handle and lever structure includes a valve actuating linkage 76 shown schematically in FIG. 4. A lever arm supporting pin 78 is mounted in apertures 79 of the arms 67, 68. Thus, the lever arm pin 78 spans between the arms 67, 68 and is located behind the spool 48 when the dispensing sub-assembly 12 and the handle and lever structure 14 are connected.

A pair of lever arms 80 are carried by the supporting pin 78. Each of the lever arms includes a forwardly projecting portion 81 adapted selectively to engage the spool positioning pins 58. The lever arms each also include a downwardly projecting linkage connected portion 82. An interconnecting linkage 84 extends rearwardly from a linkage connected portion 82 to an operator actuatable trigger 85. The trigger 85 is pivotally mounted at 86 on the stem section.

A spring shown schematically at 87 biases the valve actuating linkage toward its normal position shown in solid lines in FIG. 4. In the original preferred construction when the handle and lever structures are connected to the assembly the lever arms 80 engage the positioning pin 58 and the spool spring biases the spool 48 and the linkage 76. Operator pressure applied to the trigger 85 will shift the entire lever mechanism to the position shown in phantom lines which is a dispensing position, and in so doing move the spool to its open and dispensing position.

Figure 14:
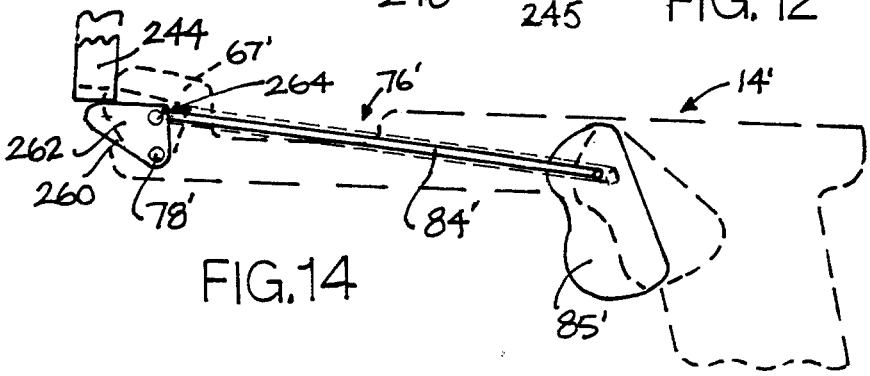
FIG. 14 is a schematic view of the a valve actuating linkage system for actuating the material dispensing sub-assembly of FIG. 12.

As shown schematically in FIG. 14, the pistol grip and handle section of the now preferred embodiment includes an actuating linkage 76'. As in the original embodiment, an arm supporting pin 78' is provided for mounting in apertures of the arms 67', 68'. Thus the supporting pin spans between the arms and is located behind the actuating member 244 of the flow control plunger 241 when the dispensing sub-assembly 12' and the handle and lever structure 14' are connected.

A cam lever arm 260 is carried by the arm supporting pin 78'. The cam 260 includes a forwardly projecting portion 262 adapted to selectively engage the actuating member 244. The cam also includes an upwardly projecting linkage connecting portion 264. An interconnecting linkage 84' extends rearwardly from the linkage connected portion to the pivotally mounted operator actuatable trigger 85'.

In the now preferred construction, the handle and lever structure 14' is engaged with the dispensing assembly at the flow control valve actuating member 244. The valve actuating linkage 76' is normally biased to the position shown in FIG. 14 in solid lines, so that the plunger 241 is in the closed position shown in FIG. 12. Operator pressure to the trigger 85' shifts the actuating linkage 76' to the dispensing position shown in phantom lines, wherein the cam moves the flow control plunger 241 to an open and dispensing position.

Figure 7:
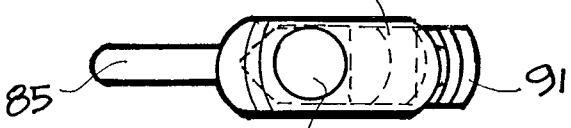
FIG. 7 is a bottom plan view of the handle section.

A mechanism for trimming an end from a cartridge nozzle 30 is depicted in FIGS. 4 and 7. For this purpose an aperture 90 is formed in the handle 64 and sized to receive a nozzle 30. The handle 64 includes a pivotally mounted blade lever 91. A blade 92 is carried by the lever 91. The lever is normally in the position shown in solid lines in FIG. 4 but is movable to the phantom line position for a nozzle severing operation.

OPERATION

To understand the operation let us assume we start with the gun empty and assembled as shown in FIG. 1. First the housing and valve sub-assembly 10 or 10' is disconnected from the dispensing sub-assembly 12 or 12'. The cutter lever 91 is moved to its phantom line position. Next the end of the nozzle 30 of the caulk cartridge 27 is inserted in the handle aperture 90. The nozzle 30 is then severed to the appropriate length by pressing the lever 91 to force the blade 92 through the nozzle. Next the cartridge is inserted in the housing 16. The housing and body 16 or 16', 36 are then threaded together until the cartridge is biased against the seal element 44 to effect a seal.

A container of liquefied gas propellant such as Freon is then coupled to the charging valve 24 and an appropriate charge of propellant is directed into the charge receiving chamber 34 or 34'. An appropriately sized and type of gun nozzle 40 is selected and attached to the body 36 if the nozzle already on the gun is not the appropriate one.

The operator now grasps the handle 64 and actuates the trigger 85. Actuation of the trigger 85 moves it from its normal to its dispensing position and with it moves the forwardly projecting portions 81 or 262 of the arms 80 or 260 to their dispensing positions. The portions 81 co-act with the spool positioning pin 58 to pull the spool downwardly against the action of the spring 49 to the dispensing position shown in FIG. 5. In the now preferred embodiment of the dispensing sub-assembly, the portions 262 act to push the actuating member 244 upwardly against the action of the spring 210 to the open and dispensing position. When sufficient caulk for a given operation has been dispensed the operator releases the trigger.

This trigger actuation is repeated until all caulk in the tube has been dispensed or a day's work has been completed. In either event, the operator should now depress the venting valve 25 and secure it in its venting position to vent any residual propellant from the charge receiving space. Note that the venting valve projects rearwardly from the opposite end 21 or 112. The purpose of the projection is to contact the operator disconnecting the sub-assemblies and thus remind him the assembly should be vented before the sub-assemblies are disconnected.

The housing sub-assembly 10 or 10' is next unscrewed from the material dispensing sub-assembly 12 or 12'. Alternately the handle and lever structure 14 or 14' could be disconnected first, if for example, it is the end of the project or the end of the day and cleanup is about to be undertaken. It is desirable, however, to remove the housing assembly 10 first because the stem and yoke sections 60, 66 are configured to shield the operator from impingement by a stream of residual propellant which may be vented through the vent passage 46.

After the housing has been removed the cartridge can be removed from it and thrown away. The handle and lever section is then disconnected from the material dispensing section by loosening the fasteners 72 and sliding the structure rearwardly relative to the sub-assembly. Next the spool retaining cap 52 is removed, the headed and threaded spring engaging element 51 is removed and the spool valve and spring 49 may now be removed for cleaning. Alternately, if a slot is formed in a lower position of the spool 48 and the pin 58 is accessible in the slot, the pin will not project outwardly of the spool and the spool, the spring 49 and the element 51 may be removed as a unit for cleaning. In the new embodiment of FIG. 12, the release knob 203 is unthreaded using an "Allen" key in the hexagonal opening 258. If the sub-assembly has not been properly vented the safety valve 230 will operate to release caulk material to the hexagonal opening as described above. If the venting procedure has been properly preformed the operator is allowed to unthread the knob from the valve body 202, and thus release the safety and flow control valve plungers 231, 241 and the spring 210 so that the entire valve passage 38' can be cleaned. Finally the nozzle should be removed enabling a full cleaning operation to be performed.

Although the invention has been described with a certain degree of particularity, it should be understood that various changes can be made to it by those skilled in the art without departing from the spirit or scope of the invention as hereinafter claimed.

We claim:

1. A liquified gas operated viscous material dispensing gun comprising:

(a) a housing sub-assembly having an elongate tubular housing defining a chamber sized to accommodate a tube of viscous material;

(b) the housing sub-assembly having an open dispensing end and an opposite valved but otherwise closed end portion;

(c) a material dispensing sub-assembly removably connectable to the dispensing end of the housing sub-assembly at a sub-assembly connection to form a dispensing assembly;

(d) the material dispensing sub-assembly including a nozzle remote from the sub-assembly connection, and having a material flow passage communicating with the chamber housing near the sub-assembly connection, the flow passage being sized to accommodate a material tube outlet;

(e) the material dispensing sub-assembly also including a valve controlled passage for selectively providing communication between an inlet portion of the flow passage and the nozzle and a flow control valve movable between open and closed positions for effecting and preventing such selective communication;

(f) the dispensing assembly including a seal mechanism positioned to effect a seal between the flow passage to chamber communication and a charge receiving portion of the chamber near the valved end portion;

(g) the valved end portion including valve means for permitting the introduction of liquefied gas into the charge receiving portion for the dispensing of material and for venting the charge receiving portion to atmosphere when the housing sub-assembly is to be disconnected from the material dispensing sub-assembly;

(h) a lever mechanism operatively connected to the flow control valve for moving the valve from one position toward the other; and (g) the part of the housing and sub-assembly which provide removable connectability including means for venting the chamber as the two are disconnected but before a disconnection is completed.

2. A liquefied gas actuated caulking mechanism comprising:

(a) an elongate tubular housing having imperforate side walls in part defining a chamber, an open end and an opposite apertured but otherwise closed end;

(b) charging and venting valves secured to the housing and closing the apertures to provide gas charging and gas venting communication selectively and one at a time between a charge receiving portion of the chamber and a gas supply and the atmosphere external of the housing;

(c) a discharge control sub-assembly, the sub-assembly and the housing being secured at an interconnection to form an assembly while permitting facile separation for removal of spent mastic cartridges from and insertion of new mastic cartridges into the chamber;

(d) the discharge control sub-assembly including a flow passage in communication with the chamber and extending to an outlet;

(e) a flow control valve intersecting the flow passage and axially movable between passage open and passage closed positions;

(f) a spring interposed between the flow control valve and other parts of the discharge control sub-assembly and biasing the valve toward its closed position such that the valve is normally closed;

(g) the assembly including a seal positioned to coact with a cartridge positioned in the chamber to block fluid communication between the charge receiving portion and the flow passage when there is a material containing tube in the chamber;

(h) a pistol grip type handle and lever structure removably connected to the assembly at a connection and including an operator actuatable trigger and an interconnected linkage, the linkages have surfaces coactable with sub-assembly surfaces to move the flow control valve against the action of the spring to its open position in response to operator actuation of the trigger; and (i) the interconnected parts include means to vent the chamber to the ambient as the housing and the sub-assembly are separated.

3. The mechanism of claim 2 wherein the means to vent the chamber comprises at least one through hole in the sub-assembly part.

4. The mechanism of claim 2 wherein the structure includes portions positioned near the means to vent to protect an operator from direct impingement by vented gases.

5. A liquified gas actuated caulking mechanism comprising:

(a) an elongate tubular housing having inperforate side walls in part defining a chamber, an open end and an opposite apertured but otherwise closed end;

(b) charging and venting valves secured to the housing and closing the apertures to provide gas charging and gas venting communication selectively and one at a time between a charge receiving portion of the chamber and a gas supply and the atmosphere external of the housing;

(c) a discharge control sub-assembly, the sub-assembly and the housing being secured at an interconnection to from an assembly while permitting facile separation for removal of spent mastic cartridges from and insertion of new mastic cartridges into the chamber;

(d) the discharge control sub-assembly including a flow passage in communication with the chamber and extending to an outlet;

(e) a flow control valve intersecting the flow passage and axially movable between passage open and passage closed positions;

(f) a spring interposed between the flow control valve and other parts of the discharge control sub-assembly and biasing the valve toward its closed position such that the valve is normally closed;

(g) the assembly including a seal positioned to coact with a cartridge positioned in the chamber to block fluid communication between the charge receiving portion and the flow passage when there is a material containing the tube in the chamber;

(h) a pistol grip type handle and lever structure removably connected to the assembly at a connection and including an operator actuatable trigger and an interconnected linkage, the linkages have surfaces coactable with sub-assembly surfaces to move the flow control valve against the action of the spring to its open position in response to operator actuation of the trigger; and (i) the interconnection between the dispensing sub-assembly and housing comprising mating helical surfaces and the means to vent the chamber comprises space between the mating helical surfaces resulting during disconnection of the interconnection.

6. A fluid operated caulking gun comprising:

(a) a material dispensing sub-assembly;

(b) an elongate housing and valve sub-assembly;

(c) a handle and lever structure;

(d) the material dispensing sub-assembly comprising:

(i) a body defining internal intersecting flow and valve passages;

(ii) the flow passage extending from a rearward end of the body removably connected to the housing sub-assembly to a forward discharge end adapted to receive a removable nozzle;

(iii) a seal carried by the body near the rearward end and interposed between the sub-assemblies;

(iv) the body including at least one radially disposed vent located between the seal and the rearward end of the body for venting gases from a housing sub-assembly chamber as such sub-assemblies are disconnected;

(v) an axially movable spool valve mounted in the valve passage;

(vi) the valve including a flow permitting portion selectively alignable with the flow passage when the spool is in an open position and flow blocking surfaces for blocking flow through the flow passage when in a closed position;

(vii) a removable valve retaining element connected to the body, the element being constructed to retain the spool in the valve passage and facilely removable to permit removal of the spool from the body for cleaning; and, (viii) a spring operably interposed between the body and the spool biasing the spool toward its closed position;

(e) the housing and valve sub-assembly comprising:

(i) a drawn housing comprising:

(aa) an elongate generally cylindrically contoured imperforate tubular portion defining the perimeter of a viscous material containing tubular cartridge chamber;

(bb) an apertured end portion closing one end of the tube other than for a pair of valve receiving apertures;

(cc) the tubular portion having an open end opposite the apertured end portion; and, (dd) the tubular portion having an externally threaded section near the open end, the threaded section being the part of the housing sub-assembly connected to the material sub-assembly;

(ii) a gas charging valve sealingly mounted in one of the closed end apertures and adapted for connection of a liquefied gas container to introduce a charge of liquefied gas into a charge receiving portion of the chamber; and, (iii) a charge receiving portion venting valve closing the other valve receiving aperture and including a venting valve actuator projecting outwardly from the apertured end portion whereby to provide a reminder to an operator disconnecting the housing and valve sub-assembly from a dispensing sub-assembly to actuate the venting valve actuator before effecting such disconnection; and, (f) the handle and lever structure comprising:

(i) a stem section adapted to abut and extend along the elongate housing;

(ii) a grippable handle section depending from the stem section in pistol grip relationship;

(iii) a yoke section forward of the handle section and projecting upwardly from the stem section when the handle is projecting downwardly;

(iv) the yoke section including a spaced pair of arms straddling the dispensing sub-assembly and including fastener receiving apertures;

(v) fasteners extending through the fastener apertures and removably connecting the structure to the material sub-assembly; and, (vi) a valve actuating linkage system including:

(aa) a trigger element pivotally connected to a selected one of the handle and stem sections and movable between a normal position and a dispensing position;

(bb) a transversely disposed lever shaft connected to a selected one of the stem and yoke sections;

(cc) a lever arm means connected to the shaft and including a forwardly projecting valve spool engagement portion and a downwardly projecting linkage connected portion; and, (dd) a linkage connecting the connected portion and the trigger such that movement of the trigger from its normal to its dispensing position will move other elements of the system including the spool engagement portion between normal and dispensing positions.

7. The gun of claim 6 wherein the fastener apertures are forwardly extending open ended slots.

8. The gun of claim 6 wherein there is a spaced pair of spool engagement portions.

9. The caulking gun of claim 6 wherein the charge receiving portion is defined by air expansible bellows disposed within the housing.

10. A dispensing sub-assembly for a fluid operated caulking gun comprising:

(a) a body defining internal intersecting flow and valve passages;

(b) the flow passage extending from a rearward end of the body adapted to be removably connected to a cartridge receiving housing to a forward discharge end adapted to receive a removable nozzle;

(c) a seal carried by the body near the rearward end;

(d) an axially movable spool valve mounted in the valve passage;

(e) the body including at least one radially disposed vent located between the seal and the rearward end of the body for venting gases from a housing chamber when such housing is disconnected from the body;

(f) the valve including a flow permitting portion selectively alignable with the flow passage when the spool is in an open position and flow blocking surfaces for blocking flow through the flow passage when in a closed position;

(g) a removable valve retaining element threadedly connected to the body, the element being constructed to contain the spool in the valve passage and being facilely removable to permit removal of the spool from the body for cleaning; and, (h) a spring operably interposed between the body and the spool biasing the spool toward its closed position.

11. The sub-assembly of claim 10 including means for removably connecting a handle and lever structure.

12. A handle and lever structure for use with an assembly to form a fluid actuated viscous material dispensing device comprising:

(a) a stem section adapted to abut and extend along an elongate housing forming part of such assembly;

(b) a grippable handle section depending from the stem section in pistol grip relationship;

(c) a yoke section forward of the handle section and projecting upwardly from the stem section when the handle is projecting downwardly;

(d) the yoke section including a spaced pair of arms for straddling a dispensing sub-assembly and including fastener apertures for removably receiving fasteners for connecting the structure to such material sub-assembly; and, (e) a valve actuating linkage system including:

(i) a trigger element pivotally connected to a selected one of the handle and stem sections and movable between a normal position and a dispensing position;

(ii) a transversely disposed lever shaft connected to a selected one of the stem and yoke sections;

(iii) a lever arm means connected to the shaft and including a forwardly projecting valve spool engagement portion and a downwardly projecting linkage connected portion; and, (iv) a linkage connecting the connected portion and the trigger such that movement of the trigger from its movable to its dispensing position will move other elements of the system including the spool engagement portion between normal and dispensing positions.

13. The structure of claim 12 wherein the fastener apertures are forwardly extending open ended slots.

14. The structure of claim 12 wherein there is a spaced pair of spool engagement portions.

15. A housing and valve sub-assembly for connection to a dispensing sub-assembly to form a liquefied gas actuating dispensing gun assembly comprising:

(a) a drawn housing comprising:

(i) an elongate generally cylindrically contoured imperforate tubular portion defining the perimeter of a viscous material containing tubular cartridge chamber;

(ii) an apertured end portion closing one end of the tube other than for a pair of valve receiving apertures;

(iii) the tubular portion having an open end opposite the apertured end portion; and (iv) the tubular portion having an externally threaded section near the open end;

(b) a gas charging valve sealingly mounted in one of the closed end apertures and adapted for connection of a liquefied gas container to introduce a charge of liquefied gas into a charge receiving portion of the chamber;

(c) a charge receiving portion venting valve closing the other valve receiving aperture and including a venting valve actuator projecting outwardly from the apertured end portion whereby to provide a reminder to an operator disconnecting the housing and valve sub-assembly from a dispensing sub-assembly to actuate the venting valve actuator before effecting such disconnection; and (d) the venting valve being constructed such that it may be selectively secured in an open position until returned to a closed position by operator action whereby to permit an operator to maintain the venting valve open as the sub-assembly is disconnected from a dispensing sub-assembly.

16. A method of dispensing viscous material from a liquified gas operated dispensing gun comprising the steps of:

(a) inserting a viscous material cartridge into a housing and valve sub-assembly for sealing engagement between the cartridge and sub-assembly;

(b) assembling said dispensing gun by removably connecting the housing and valve sub-assembly with a material dispensing sub-assembly to form a dispensing assembly;

(c) coupling a container of liquified gas to a charging valve in the housing and valve sub-assembly;

(d) loading gas propellant from the container through the charging valve into the housing and valve sub-assembly;

(e) disconnecting the container from the charging valve;

(f) preventing the flow of the propellant through a material flow passage using a seal and an element adapted to bias material for flow;

(g) actuating a trigger mechanism interconnected with the material dispensing sub-assembly to move a spring biased flow control valve between normal and dispensing positions;

(h) dispensing viscous material flowing through a nozzle through said flow control valve via a material flow passage in response to trigger actuation;

(i) reloading said dispensing gun by actuating a venting valve in the housing and valve sub-assembly to relieve the gun of residual propellant;

(j) disconnecting the sub-assemblies;

(k) removing a spent material cartridge from the housing and valve sub-assembly;

(l) inserting another material cartridge into the housing and valve sub-assembly;

(m) reconnecting the sub-assemblies to form the dispensing assembly;

(n) recharging the charging valve in the housing and valve sub-assembly with gas propellant from the container;

(o) disconnecting the container from the charging valve; and (p) actuating the trigger mechanism to resume dispensing viscous material from said dispensing gun; and (q) allowing residual propellant to vent through a passage opened during disconnection as the sub-assemblies are being disconnected.

17. A handle and lever structure for use with an assembly to form a fluid actuated viscous material dispensing device comprising:

(a) a stem section adapted to abut and extend along an elongate housing forming part of such assembly;

(b) a grippable handle section depending from the stem section in pistol grip relationship;

(c) a yoke section forward of the handle section and projecting upwardly from the stem section when the handle is projecting downwardly;

(d) the yoke section including a spaced pair of arms for straddling a dispensing sub-assembly and including fastener apertures for removably receiving fasteners for connecting the structure to such material sub-assembly; and, (e) a valve actuating linkage system including:

(i) a trigger element pivotally connected to a selected one of the handle and stem sections and movable between a normal position and a dispensing position;

(ii) a transversely disposed lever shaft connected to a selected one of the stem and yoke sections;

(iii) a lever arm means connected to the shaft and including a valve spool engagement portion and a linkage connected portion; and, (iv) a linkage connecting the connected portion and the trigger such that on movement of the trigger from its normal to its dispensing position other elements of the system including the spool engagement portion will move between normal and dispensing positions.

* * * * *